US008540527B2

(12) United States Patent
Puluc et al.

(10) Patent No.: US 8,540,527 B2
(45) Date of Patent: Sep. 24, 2013

(54) JUMPER CABLE PLUG WITH MOISTURE RESISTANT SEAL

(75) Inventors: Oscar A. Puluc, Downey, CA (US); Zhimin Guo, Cerritos, CA (US); Thomas D. Peterson, Covina, CA (US)

(73) Assignee: R.A. Phillips Industries, Inc., Santa Fe Springs, CA (US)

( * ) Notice: Subject to any disclaimer, the term of this patent is extended or adjusted under 35 U.S.C. 154(b) by 45 days.

(21) Appl. No.: 13/368,249

(22) Filed: Feb. 7, 2012

(65) Prior Publication Data

US 2012/0202377 A1 Aug. 9, 2012

Related U.S. Application Data

(63) Continuation-in-part of application No. 13/022,629, filed on Feb. 7, 2011, now Pat. No. 8,192,216.

(51) Int. Cl.
*H01R 4/00* (2006.01)

(52) U.S. Cl.
USPC ..... 439/271; 439/680

(58) Field of Classification Search
USPC ..... 439/271, 680, 272
See application file for complete search history.

(56) References Cited

U.S. PATENT DOCUMENTS

| | | | | |
|---|---|---|---|---|
| 4,109,989 | A | 8/1978 | Snyder, Jr. et al. | |
| 4,637,674 | A | 1/1987 | Kobler | |
| 5,358,429 | A | 10/1994 | Mina | |
| 5,863,221 | A | 1/1999 | Castaldo | |
| 7,097,469 | B2 | 8/2006 | Jacobs | |
| 8,187,042 | B2 * | 5/2012 | Kimura | 439/752 |

OTHER PUBLICATIONS

Combined International Search Report and Written Opinion in corresponding PCT Application No. US2012/054296 dated Nov. 27, 2012; 11 pages.

* cited by examiner

*Primary Examiner* — Gary F. Paumen
(74) *Attorney, Agent, or Firm* — Christie, Parker & Hale, LLP

(57) ABSTRACT

An electrical plug configured to be mated with a socket, the electrical plug including a substantially tubular plug housing having a front end, a rear end, a side wall between the front end and the rear end, and a housing protrusion on the side wall and configured to be inserted within a socket cutout of the socket, a groove proximate the front end of the housing, and a seal located in the groove and having a cross-section with an outer surface that is substantially similar to an outer surface of a cross-section of the side wall and the housing protrusion.

20 Claims, 3 Drawing Sheets

JUMPER CABLE PLUG WITH MOISTURE RESISTANT SEAL

CROSS-REFERENCE TO RELATED APPLICATION(S)

This application is a continuation-in-part of U.S. patent application Ser. No. 13/022,629, filed Feb. 7, 2011 now U.S. Pat. No. 8,192,216, entitled JUMPER CABLE PLUG WITH MOISTURE RESISTANT SEAL, the contents of which are expressly incorporated herein in their entirety.

FIELD

The present invention relates to electrical plugs and sockets, such as, but not limited to, jumper cable plugs and sockets used to electrically connect jumper cables between and trailer and a tractor, truck, other trailer, etc.

BACKGROUND

Heavy duty trucks and tractor trailers typically involve a semi-trailer truck, or a tractor-trailer, having a trailer connected thereto. The trailer typically requires one or more electrical systems associated with turn signals, hazard signals, brake signals, braking systems, system monitoring, lighting, etc. These electrical systems are typically controlled or monitored from within the cab of the semi/tractor. Accordingly, an electrical connection is typically required between the semi/tractor and the trailer. Because the trailer is typically detachable from the semi/tractor, the electrical connection therebetween is also typically detachable. This detachable electrical connection typically takes the form of a plug-and-socket connection, wherein the socket may have one or more electrical connections (e.g., male pins) for mating with corresponding electrical connections (e.g., female terminals) of the plug.

A problem commonly associated with common plug-and-socket connections stems from moisture and debris reaching an interior of the socket cavity. The presence of moisture or debris may damage or corrode metallic connections, such as the electrical connections, which may in turn degrade or otherwise negatively effect the electrical connections between the semi/tractor and the trailer.

SUMMARY

Accordingly, there is a need for an improved jumper cable plug, wherein a moisture and debris resistant seal is formed when the plug is mated with a corresponding socket, thereby extending the useful life of the plug, the socket, and the electrical connections between the semi/tractor and the trailer. Although much of the following description describes jumper cable plugs and corresponding sockets, embodiments of the present invention may also take the form of other types of electrical plugs and corresponding sockets.

One embodiment of the present invention includes an electrical plug configured to be mated with a socket, the electrical plug including a substantially tubular plug housing having a front end, a rear end, a side wall between the front end and the rear end, and a housing protrusion on the side wall and configured to be inserted within a socket cutout of the socket, a groove proximate the front end of the housing, and a seal located in the groove and having a cross-section with an outer surface that is substantially similar to an outer surface of a cross-section of the side wall and the housing protrusion.

The plug may further include a substantially tubular electrical connection holder including a front, a rear, a side, and a connection holder protrusion on the side of the electrical connection holder, the housing may further include a housing cutout for accommodating the connection holder protrusion, and the electrical connection holder may be configured to be partially housed by the housing.

The electrical connection holder may further include a flange at the front of the electrical connection holder, the flange having an outer diameter approximately equal to an outer diameter of the housing, and the groove may be formed between the flange and the housing.

A portion of the connection holder protrusion may be within the groove, and the seal may have a seal cutout for accommodating the portion of the connection holder protrusion within the groove.

A portion of the side wall of the housing may define the housing protrusion and the housing cutout.

The side wall of the housing may have a first hole therethrough, wherein the side of the electrical connection holder has a second hole therein that is aligned with the first hole when the electrical connection holder is housed within the housing, and wherein the plug further includes a securing mechanism passing through the first hole into the second hole to fix the electrical connection holder to the housing.

The electrical connection holder may have a plurality of channels for receiving corresponding electrical terminals of the socket when the plug and the socket are mated.

Rotation of the electrical connection holder within the housing may be prevented when the connection holder protrusion is received by the housing cutout.

The housing protrusion and the socket cutout may ensure alignment of respective electrical connections of the plug and the socket when the plug and the socket are mated.

The plug may further include a pull tab on the housing.

A rear of the housing protrusion may be for engaging with a locking tab of the socket when the plug and the socket are mated.

The plug may further include a protuberance extending from the side wall of the housing farther than a front of the housing protrusion.

The seal and an interior of the socket may form a moisture resistant barrier when the plug is mated with the socket.

A portion of a rear of the seal may abut a front of the housing protrusion.

According to another embodiment of the present invention, there is provided an electrical plug configured to be mated with a socket, the electrical plug including a substantially tubular plug housing including a front end, a rear end, a side wall between the front end and the rear end, and a housing protrusion located on the side wall and configured to be inserted within a socket cutout of the socket, and a groove proximate the front end of the housing and configured to receive a seal having a cross-section with an outer surface that is substantially similar to an outer surface of a cross-section of a combination of the side wall of the housing and the housing protrusion.

The plug may further include a substantially tubular electrical connection holder in the front end of the housing, and the groove may be between a front of the electrical connection holder and the front end of the housing.

The electrical connection holder may include a connection holder protrusion, and the housing may have a housing cutout on an interior of the housing configured to receive the connection holder protrusion.

A portion of the connection holder protrusion may be in the groove.

The plug may further include a screw for securing the electrical connection holder to the housing.

The housing protrusion may be configured to be stopped by a locking tab on a lid of the socket that is configured to cover an opening of the socket when the plug and the socket are unmated.

Accordingly, embodiments of the present invention an improved jumper cable plug capable of reducing the presence of moisture and debris at the electrical connections by use of a moisture resistant seal.

DETAILED DESCRIPTION

Figure 1:
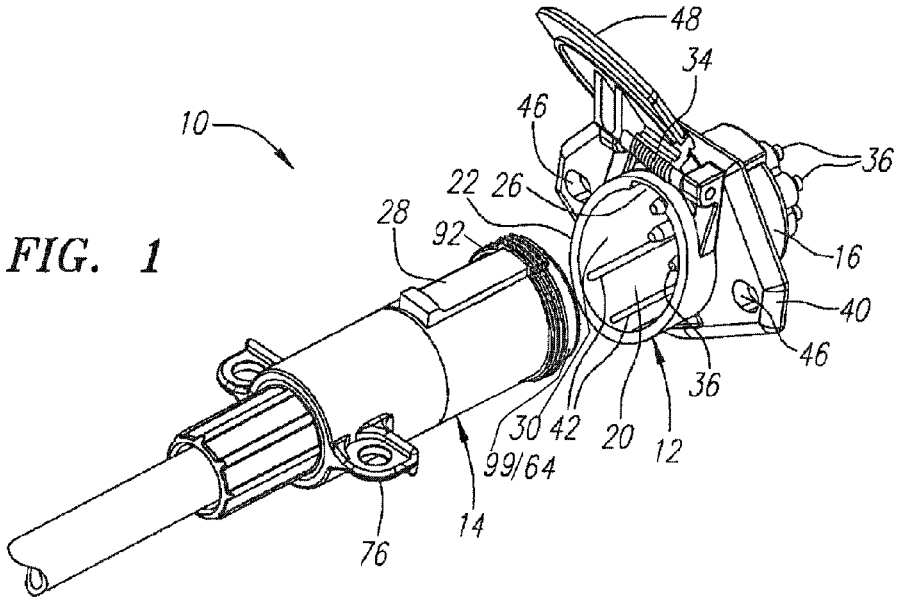
FIG. 1 is a perspective view of a socket and a jumper cable plug (shown an unmated position) in accordance with one embodiment of the present invention.

Embodiments of the present invention will now be described with reference to the figures, wherein like reference numerals represent like elements. Furthermore, for ease of description, reference to a "front" of a plug, socket, or a component thereof, shall generally refer to a portion that is most proximate a mating end of the plug or socket, while reference to a "rear" of a plug, socket, or component thereof, shall generally refer to a portion that is least proximate the mating end of the plug or socket.

Exemplary embodiments of the present invention are described with reference to FIGS. 1-11 below. Plugs (e.g., jumper cable plugs) of the exemplary embodiments of the present invention, as well as sockets of the exemplary embodiments of the present invention, incorporate numerous aspects, and it should be noted that the present invention is not restricted to the exemplary embodiments, as various combinations of the described aspects may be made without departing from the spirit and scope of the present invention.

Figure 2:
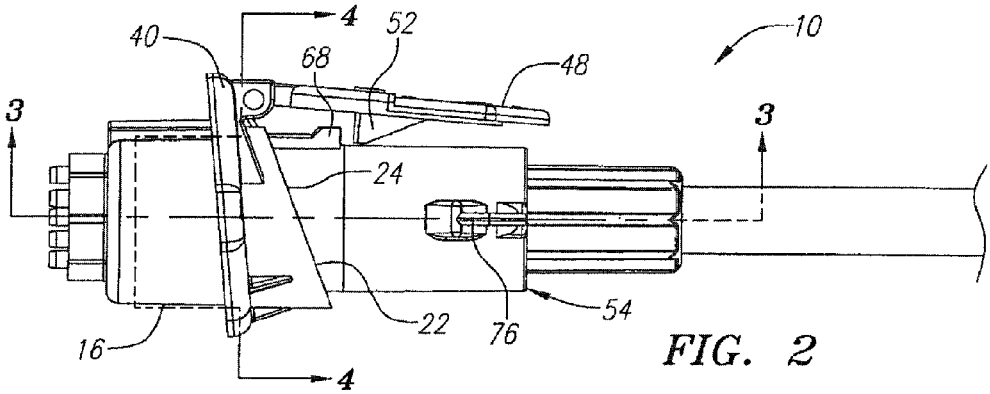
FIG. 2 is a side elevational view of the plug and the socket (shown in the mated position) of the embodiment shown in FIG. 1.

FIG. 1 is a perspective view of an electrical connection interface 10 of an embodiment of the present invention having a socket 12 and a jumper cable plug 14, which are shown in an unmated condition. FIG. 2 is an elevated view of the socket 12 and the plug 14 of the embodiment shown in FIG. 1, the socket 12 and the plug 14 shown in a mated condition. The plug 14 includes a plug housing 54 having a key 28, an electrical connection holder/electrical terminal holder 64 partially housed by the housing 54, and a seal ring 92 about the electrical connection holder 64 between the housing 54 and a front of the electrical connection holder 64, the seal ring 92 having a shape allowing a rear of the seal ring 92 to conform to the front 66 of the housing 54 (shown in FIGS. 7, 8, and 11) including the key 28. Accordingly, when the plug 14 is mated with the socket 12, an outer portion of the seal ring 92 is brought in close contact with an interior 30 of the socket 12 to form a moisture resistant seal.

The plug 14 of the present embodiment includes a generally tubular/cylindrical housing 54, while the socket 12 includes a wall 22 that defines a generally cylindrical cavity 20 for receiving the plug 14, the cavity 20 being open at a front end of the socket 12. The cavity 20 additionally includes a keyway 26 (e.g., a cutout) defined by an interior 30 of the wall 22 of the socket 12. The keyway 26 is shaped to accommodate the key 28 (e.g., a protrusion/protuberance, which may be longitudinal) formed on a side of the housing 54 of the plug 14. The key 28 may be integrally formed with the housing 54. The keyway 26 and the key 28 allow proper orientation of the plug 14 and the socket 12 during mating of the plug 14 and socket 12, and therefore also allow proper orientation of the electrical connections (e.g., male pins 36 and female terminals 38, shown in FIGS. 3-5) of the plug 14 and the socket 12. Although the present embodiment depicts male pins 36 of the socket 12 and female terminals 38 of the plug 14, other embodiments may include different arrangements, for example, wherein the plug comprises male terminals, and the socket comprises female terminals, or wherein electrical connections are made without pins and terminals.

The interior surface 30 of a socket barrel 16 of the socket 12 of the present embodiment includes a plurality of elongated ribs 42 that extend in a longitudinal direction of the socket 12 to facilitate drainage of moisture or water from the cavity 20. In embodiments of the present invention, opposing ribs 42 may be provided on opposite sides of the interior surface 30 of the barrel 16 to ensure that the plug 14 remains properly spaced from interior surface 30. However, other embodiments of the present invention may include an interior surface of a socket that does not include ribs 42.

The socket 12 of the present embodiment includes one or more mounting holes 46 formed through a flange 40 of the socket 12 to facilitate mounting the socket 12 to an exterior wall of a semi/tractor or a trailer, although such mounting holes 46 are not necessary for the practice of invention.

The key 28 of the plug 14 of the present embodiment is formed on the plug housing 54 and extends longitudinally along the plug housing 54. A rear of the key 28 of the present embodiment may also comprise an additional protrusion/protuberance 68, which extends from the plug housing 54 further than a front of the key 28 (e.g., the protuberance 68 is thicker than the remainder of the key 28). Although the present embodiment includes the additional protrusion/protuberance 68 other embodiments of the present invention may include the key 28 without the additional protrusion/protuberance 68, or with a differently located protrusion/protuberance. Furthermore, other embodiments may include differently shaped keys or key/protuberance combinations (such as a key that has a slope that evenly rises from front to back).

The socket 12 of the present embodiment may include a hinged lid 48 including a biasing member 34, such as a torsional coil spring, to cause the lid 48 to cover an opening at the front of the cavity 20 when the socket 12 is unmated with the plug 14. The lid 48 may further include a locking tab 52, so that, while the plug 14 is mated to socket 12, the biasing member 34 biases the lid 48 towards the plug 14 (e.g., towards an upper surface of the plug 14). The biasing member 34 causes the locking tab 52 to contact a surface of the housing 54 rearward of the protuberance 68 or the rear end of the key 28, causing the locking tab 52 of the lid 48 to act as a stop by contacting the protuberance 68 or the key 28, thereby reducing the likelihood of the plug 14 being inadvertently removed from the cavity 20 of the socket 12. When the plug 14 is desired to be withdrawn from the socket 12, the lid 48 may be lifted against the biasing force, allowing the protuberance 68 or the key 28 to clear the locking tab 52. Although the locking tab 52 of the present embodiment is a part of the lid 48, other embodiments of the present invention may include a differently located locking tab (e.g., on an interior of the socket). Although the protuberance 68 of the present embodiment extends from the housing 54 further than the key 28, other embodiments of the present invention may include a key without an additional protuberance, which may be stopped by a locking tab of the socket when the plug and socket are mated.

The housing 54 may have an interior space 62, and may include one or more pull tabs 76 that extend outwardly from the plug housing 54 to facilitate removal of the plug 14 from socket 12, although other embodiments of the present invention may lack pull tabs 76. The plug 14 of the present embodiment includes opposing pull tabs 76 adjacent a rear of housing 54 and extending from the sides of the housing 54, allowing a user to remove the plug 14 from the socket 12 without pulling on the wires exiting the rear of the housing 54, potentially damaging the electrical connection between the wires and the electrical terminals (e.g., female terminals 38) of the plug 14.

Referring to FIGS. 3-8 and 11, the plug 14 of present embodiment also includes the electrical connection holder/electrical terminal holder 64 near a front end/portion 66 of the housing 54. The electrical connection holder 64 of the present embodiment is configured to substantially block the opening at the front end 66 of the housing 54 by being inserted into the interior space 62 of the plug housing 54. However, in other embodiments, the electrical connection holder 64 may be integrally formed with, or otherwise coupled to, the plug housing 54. In the present embodiment, a screw 88 (shown in FIG. 6) is configured to fix the electrical connection holder 64 in a stable position within the housing 54. The electrical connection holder 64 of the present embodiment includes channels 70 of the plug 14 that match the pin pattern of the male pins 36 of the socket 12 and that are sized to receive metallic female terminals 38. Other embodiments of the present invention may include more than one screw, or may secure the electrical connection holder 64 to the housing 54 by other means.

The electrical connection holder 64 of the present embodiment is generally cylindrical/circular, and has a flange 99 at a front of the electrical connection holder 64 that has a diameter that is slightly greater than a diameter of the rest of the electrical connection holder 64. Accordingly, an annular groove 78 may be formed behind the flange 99, between the front of the electrical connection holder 64 and the front portion 66 of the plug housing 54 (see FIG. 11), such that the annular groove 78 may be within the socket cavity 20 when the plug 14 is mated with the socket 12. In the present embodiment, a cross-section of the electrical connection holder 64 has a shape similar to that of the plug housing 54 and key 28, although the size of the cross-section of the electrical connection holder 64 is smaller than that of the plug housing 54. Accordingly, the shape of the groove 78 tracks the outer profile of the plug housing 54/key 28, and will similarly have a key 82 on a side of the electrical connection holder 64 and extending from the flange 99 (see FIG. 11). The key 82 will correspond to a keyway 84 of the plug housing 54 located beneath the key 28, and on an interior 62 of the plug housing 54 (e.g., a portion of the side wall of the plug housing 54 that defines the keyway 84 on the interior 62 of the housing 54 also defines the key 28 on the exterior of the housing 54). Accordingly, a cross-section of the interior 62 of the plug housing 54 of the present embodiment has a shape similar to, albeit having smaller dimensions than, a cross-section of the interior 30 of the socket 12. Just as the plug 14 may be aligned with and inserted into the socket 12, the electrical connection holder 64 may be aligned with and inserted into the plug housing 54.

Figure 11:
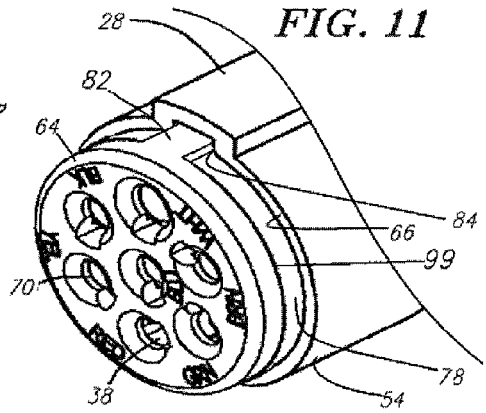
FIG. 11 is a partial perspective view of the electrical connection holder and a front of the plug housing of the embodiment shown in FIG. 5 with seal ring removed.
Figure 8:
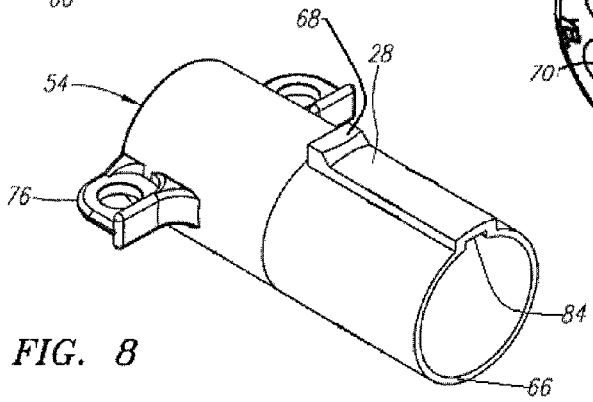
FIG. 8 is a perspective view of the plug housing of the plug of the embodiment shown in FIG. 1.

In this embodiment, because the key 82 of the electrical connection holder 64 extends from the flange 99 of the electrical connection holder 64 into the plug housing 54, the key 82 is present at a portion of annular groove 78 (see FIG. 11). The presence of the key 82 in the groove 78 is used to position and help retain the seal ring 92 within the annular groove 78. Accordingly, and referring to FIGS. 9 and 10, the seal ring 92 of the embodiment shown in FIGS. 1, 3-6, 9, and 10 includes a corresponding recess 91 for receiving a portion of the key 82 of the electrical connection holder 64 proximate the flange 99, and a cross-section of the seal ring 92 has a substantially uniform thickness that is slightly more than the depth of the groove 78 (e.g., slightly more than the width of the side wall of the housing 54). Because the groove 78 tracks the outer profile of the plug housing 54, so does the seal ring 92, wherein the outer profile of the seal ring 92 is slightly further from a central axis of the plug housing 54 than an exterior of the plug housing 54. In other embodiments, protuberance 82 may be located in other positions of the groove 78, with the corresponding keyway 84 of the housing 54 being correspondingly located. Further, more than one protuberance 82 and more than one corresponding recess in the seal ring 92 may be employed in other embodiments of the present invention.

Figure 3:
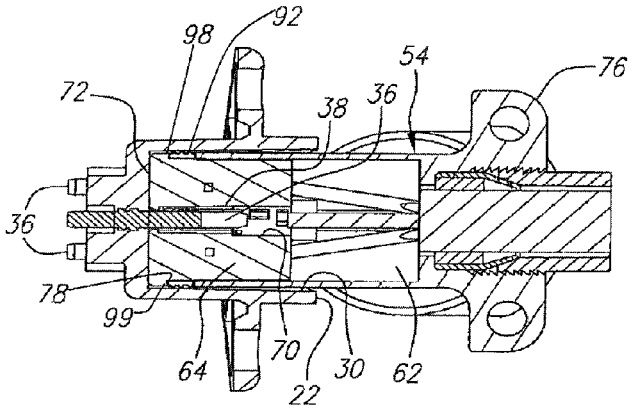
FIG. 3 is a cross-sectional view of the plug and the socket of FIG. 2 taken along line 3-3.
Figure 4:
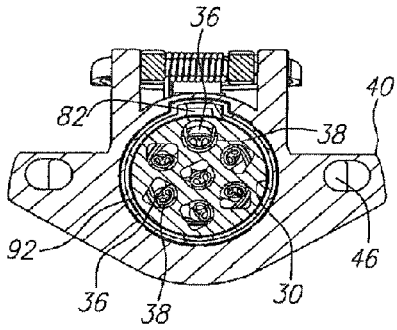
FIG. 4 is a cross-sectional view of the plug and the socket of FIG. 2 taken along line 4-4.
Figure 5:
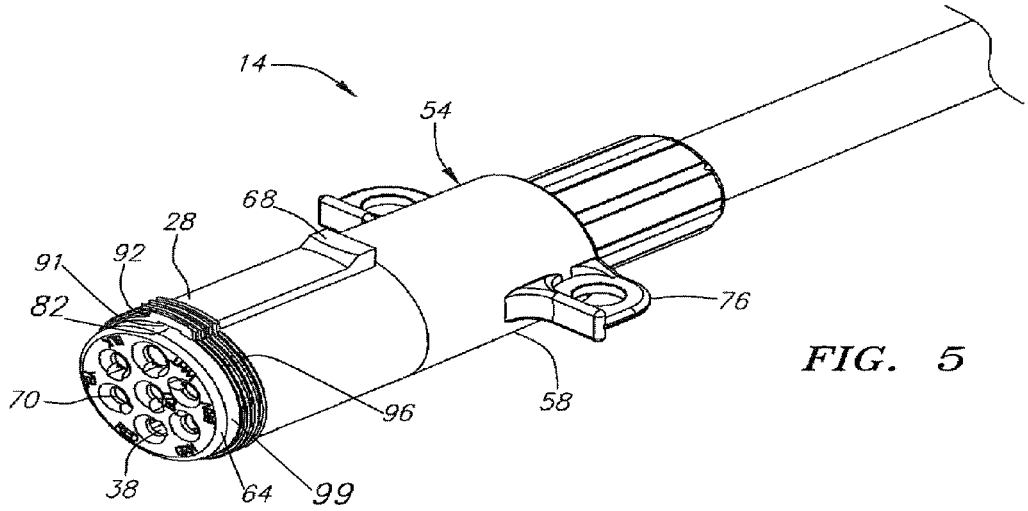
FIG. 5 is a perspective view of the plug of the embodiment shown in FIG. 1.
Figure 6:
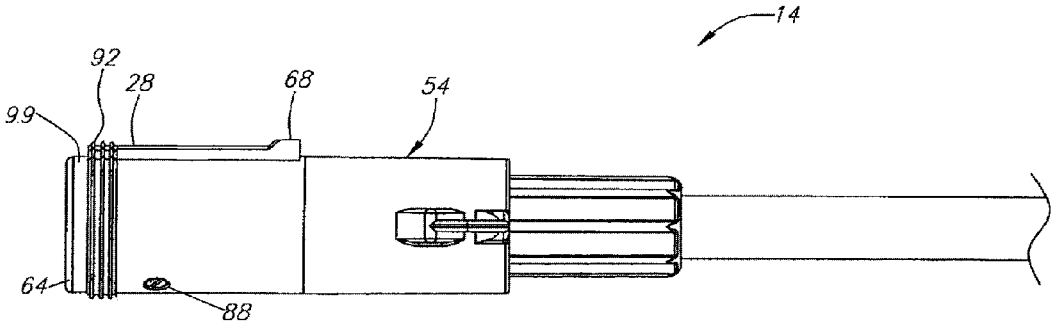
FIG. 6 is a side elevational view of the plug of the embodiment shown in FIG. 1.
Figure 7:
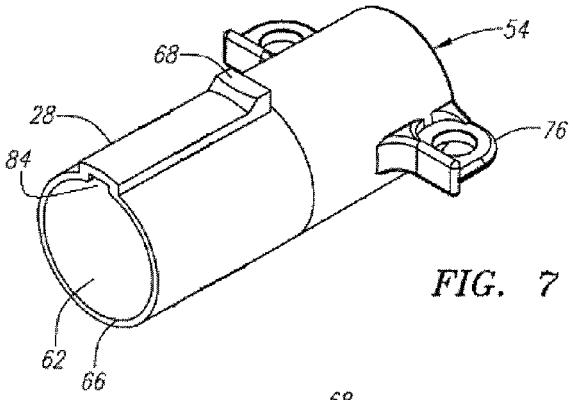
FIG. 7 is a perspective view of a plug housing of the plug of the embodiment shown in FIG. 1.

The resilient seal ring 92 of the present embodiment has a width corresponding to that groove 78 in which it is located (e.g., the distance between a rear of the flange 99 of the electrical connection holder 64 and the front of the housing 54) so that the seal ring 92 may be received by the groove 78. Further, the seal ring 92 has a cross-section of a shape and size that is substantially similar to that of the plug housing 54, and has an interior contour that corresponds to the cross-sectional profile of the annular groove 78 so that the seal ring 92 can be tightly fitted around the electrical connection holder 64 between the flange 99 of the electrical connection holder 64 and the front 66 of the plug housing 54 within annular groove 78. Because the seal ring 92 is seated within the groove 78, and as shown in FIGS. 2-4, when the plug 14 is mated with the socket 12, the resilient seal ring 92 will be positioned within the cavity 20.

Although not required, embodiments of the present invention may utilize an adhesive to bond the seal ring 92 within the annular groove 78. Alternatively, and according to other embodiments, instead of being adhesively bonded, the seal ring 92 may be over-molded onto the annular groove 78, or may be co-molded with the electrical connection holder 64 so that the electrical connection holder 64 is injection molded around the seal ring 92. Alternatively, if a material with a sufficient glass transition temperature is used, the seal ring 92 may be co-molded with the plug housing 54 so that the plug housing 54 is injection molded around the seal ring 92. In this way, the seal ring 92 may provide features which improve the mechanical bonding between the seal ring 92 and plug housing 54.

Figure 9:
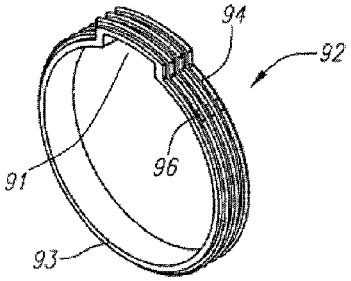
FIG. 9 is a perspective view a seal ring in accordance with an embodiment of the present invention.
Figure 10:
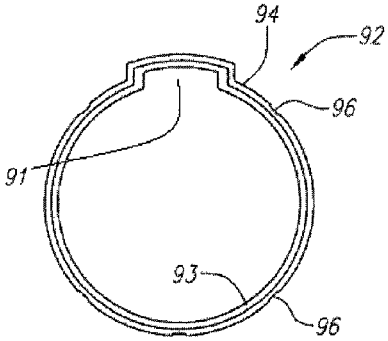
FIG. 10 is a plane view of the seal ring of the embodiment shown in FIG. 9.

Referring to FIGS. 9-10, the resilient seal ring 92 of the present embodiment includes a base portion 93, which seats in the annular groove 78 and a plurality of flexible ribs 94 integrally formed therewith. The flexible ribs 94 extend radially outward from the base 93 about its circumference. In the present embodiment, three flexible ribs 94 are provided, and the seal ring 92 (including the ribs 94) is made from a rubber material, such as EPDM rubber or silicone rubber, although other resilient materials can be used to make the resilient seal ring 92 in other embodiments. In other embodiments, other forms of seal rings may be employed. For example, a different number of ribs may be used. Furthermore, the seal ring 92 of the present embodiment includes a plurality of relief cuts 96 that are formed in the ribs 94 of the seal ring 92 and that are positioned and sized to align with and receive the ribs 42 of the socket 12 when the plug 14 and the socket 12 are mated, although other embodiments of the present invention may lack the relief cuts 96.

When the plug 14 is inserted into the cavity 20 of the socket 12, a substantially sealed internal volume 98 is formed due to the resilient seal ring 92. Because the seal ring 92, including the ribs 94, is made of a generally resilient material, the seal ring 92 conforms to the profile of the interior surface 30 of wall 22 to form a water-resistant, if not water-tight, seal. Furthermore, by using a plurality of ribs 94 (e.g., three in the seal ring of the present embodiment), each rib 94 may form a separate seal with the interior 30 of the socket 12, thereby providing redundant protection from moisture and debris. Therefore, when the plug 14 is mating with the socket 12, the female terminals 38 of plug 14 and the male pins 36 of the socket 12 will be protected from moisture in the environment, thereby reducing the potential for corrosion that moisture and debris may cause.

While embodiments of the invention presented above have been shown and described as comprising a plug with female terminals so that a mating socket has male pins, it is within the scope of the invention for the electrical terminals to be reversed so that the plug has male pins and the mating socket has female terminals, or for the plug and the socket to have other electrical connections. If the plug 14 is constructed to comply with a particular SAE or ISO standard, then the plug 14 will mate with any socket that has also been constructed according to the standard. Thus, the plug 14 of the present patent document will provide water-resistant, if not water-tight seals when coupled to sockets used with existing trucks or trailers.

Furthermore, although the present invention has been particularly shown and described with reference to exemplary embodiments thereof, it will be understood by those of ordinary skill in the art that features of different embodiments may be combined to form further embodiments, and that various changes, modifications and adaptations in form and details of the invention are possible without departure from the spirit and scope of the invention. Thus the present invention has been described by way of illustration and not limitation, and is defined by the following claims and their equivalents.

What is claimed is:

1. An electrical plug configured to be mated with a socket, the electrical plug comprising:

a substantially tubular plug housing having:

a front end;

a rear end;

a side wall between the front end and the rear end; and a housing protrusion on the side wall and configured to be inserted within a socket cutout of the socket;

a groove proximate the front end of the housing; and a seal located in the groove and having a cross-section with an outer surface that is substantially similar to an outer surface of a cross-section of the side wall and the housing protrusion.

2. The plug of claim 1, further comprising a substantially tubular electrical connection holder comprising a front, a rear, a side, and a connection holder protrusion on the side of the electrical connection holder, wherein the housing further comprises a housing cutout for accommodating the connection holder protrusion, and wherein the electrical connection holder is configured to be partially housed by the housing.

3. The plug of claim 2, wherein the electrical connection holder further comprises a flange at the front of the electrical connection holder, the flange having an outer diameter approximately equal to an outer diameter of the housing, and wherein the groove is formed between the flange and the housing.

4. The plug of claim 2, wherein a portion of the connection holder protrusion is within the groove, and wherein the seal has a seal cutout for accommodating the portion of the connection holder protrusion within the groove.

5. The plug of claim 2, wherein a portion of the side wall of the housing defines the housing protrusion and the housing cutout.

6. The plug of claim 2, further wherein the side wall of the housing has a first hole therethrough, wherein the side of the electrical connection holder has a second hole therein that is aligned with the first hole when the electrical connection holder is housed within the housing, and wherein the plug further comprises a securing mechanism passing through the first hole into the second hole to fix the electrical connection holder to the housing.

7. The plug of claim 2, wherein the electrical connection holder has a plurality of channels for receiving corresponding electrical terminals of the socket when the plug and the socket are mated.

8. The plug of claim 2, wherein rotation of the electrical connection holder within the housing is prevented when the connection holder protrusion is received by the housing cutout.

9. The plug of claim 1, wherein the housing protrusion and the socket cutout ensure alignment of respective electrical connections of the plug and the socket when the plug and the socket are mated.

10. The plug of claim 1, further comprising a pull tab on the housing.

11. The plug of claim 1, wherein a rear of the housing protrusion is for engaging with a locking tab of the socket when the plug and the socket are mated.

12. The plug of claim 11, further comprising a protuberance extending from the side wall of the housing farther than a front of the housing protrusion.

13. The plug of claim 1, wherein the seal and an interior of the socket form a moisture resistant barrier when the plug is mated with the socket.

14. The plug of claim 1, wherein a portion of a rear of the seal abuts a front of the housing protrusion.

15. An electrical plug configured to be mated with a socket, the electrical plug comprising:

a substantially tubular plug housing comprising:

a front end;

a rear end;

a side wall between the front end and the rear end; and a housing protrusion located on the side wall and configured to be inserted within a socket cutout of the socket; and a groove proximate the front end of the housing and configured to receive a seal having a cross-section with an outer surface that is substantially similar to an outer surface of a cross-section of a combination of the side wall of the housing and the housing protrusion.

16. The plug of claim 15, further comprising a substantially tubular electrical connection holder in the front end of the housing, wherein the groove is between a front of the electrical connection holder and the front end of the housing.

17. The plug of claim 16, wherein the electrical connection holder comprises a connection holder protrusion, and wherein the housing has a housing cutout on an interior of the housing configured to receive the connection holder protrusion.

18. The plug of claim 17, wherein a portion of the connection holder protrusion is in the groove.

19. The plug of claim 16, further comprising a screw for securing the electrical connection holder to the housing.

20. The plug of claim 15, wherein the housing protrusion is configured to be stopped by a locking tab on a lid of the socket that is configured to cover an opening of the socket when the plug and the socket are unmated.

* * * * *